United States Patent [19]

Jackson

[11] 4,401,532

[45] Aug. 30, 1983

[54] RADIOACTIVE DECONTAMINATION APPARATUS AND PROCESS

[76] Inventor: Opha L. Jackson, P.O. Box 1627, Brooksville, Fla. 33512

[21] Appl. No.: 267,981

[22] Filed: May 28, 1981

[51] Int. Cl.[3] ..... C25F 3/16; C25F 7/00

[52] U.S. Cl. ..... 204/129.1; 204/225; 204/238

[58] Field of Search ..... 204/129.1, 129.5, 225, 204/226, 141.5, 238, 278

[56] References Cited

U.S. PATENT DOCUMENTS

| | | | |
|---|---|---|---|
| 2,665,247 | 1/1954 | Jumer | 204/225 |
| 3,320,175 | 5/1967 | Podberesky | 204/149 |
| 3,515,655 | 6/1970 | Raviv | 204/145 R |
| 3,657,012 | 4/1972 | Verot | 134/26 |
| 3,873,362 | 3/1975 | Mihram | 134/3 |
| 4,063,962 | 12/1977 | Arya | 134/8 |
| 4,193,853 | 3/1980 | Childs | 204/129.75 |
| 4,318,786 | 3/1982 | Tahoda | 204/141.5 |

*Primary Examiner*—T. M. Tufariello

*Attorney, Agent, or Firm*—Sughrue, Mion, Zinn, Macpeak & Seas

[57] ABSTRACT

Apparatus for removing radioactive contamination from metal objects is disclosed, consisting of three of three separate pieces. The first is an electro-polishing tank, pump and filter assembly, ventilation duct and filter assembly, and DC power supply. The second is a rinse tank and a pump and filter assembly therefor. The third is a divot crane. The electro-polishing tank assembly and the rinse tank assembly are each separately mounted on pallets to facilitate moving. The filter systems of the electro-polishing tank and the rinse tank are designed to remove the radioactive contamination from the fluids in those tanks. Heavy items or highly contaminated items are handled with the divot crane constructed of stainless steel. The electro-polishing tank and the rinse tank are also made of stainless steel. The ventilation system on the electro-polishing tank exhausts acid fumes resulting from the tank heaters and the electro-polishing process. Inside the electro-polishing tank are two swinging arms that carry two stainless steel probes that hang down in the electrolyte fluid. These are negative DC probes and are electrically isolated from the tank and the rest of the system. Across the top center of the tank is a copper pipe, which is also electrically isolated from the tank. This is the positive side of the DC system. To decontaminate a metal object, it is suspended from the positive copper pipe, with good electrical contact, into the electrolyte fluid. The negative probes are then moved on their swinging arms to a close proximity to the object being decontaminated, without making contact.

12 Claims, 4 Drawing Figures

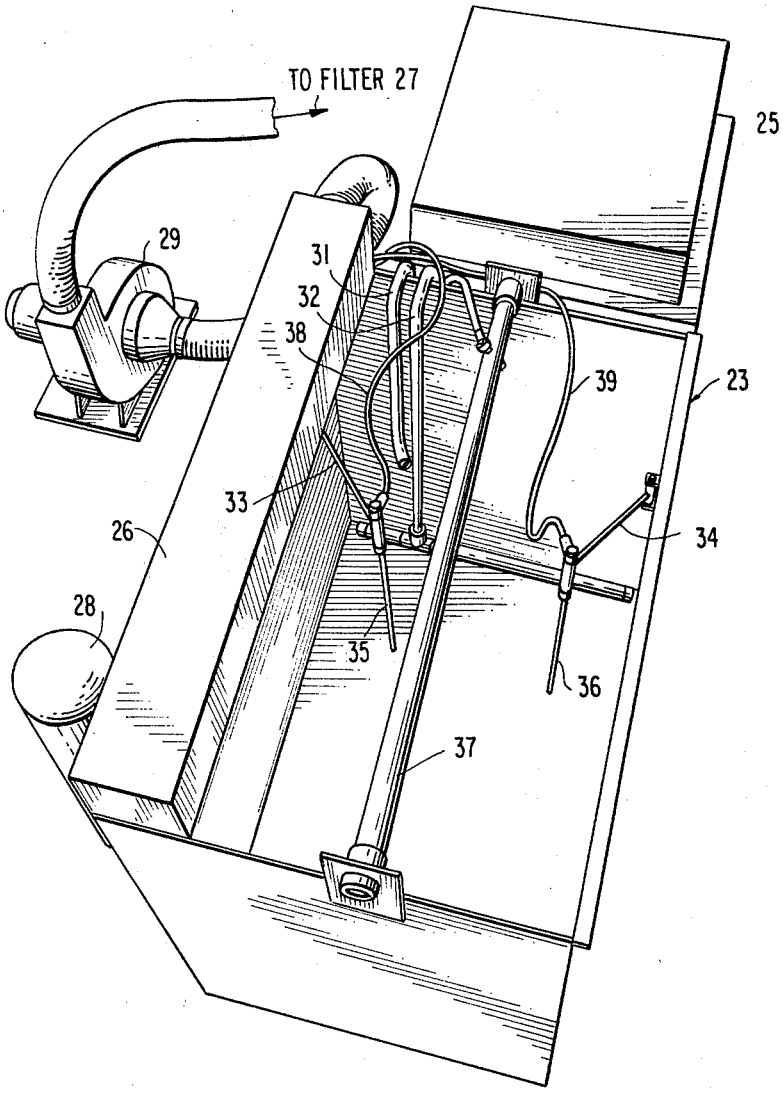
FIG. 3
FIG. 4
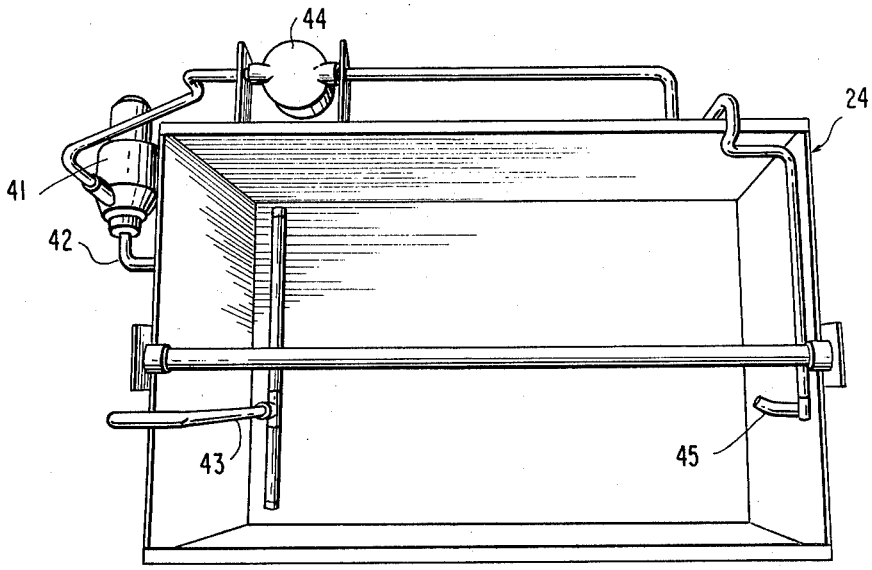

RADIOACTIVE DECONTAMINATION APPARATUS AND PROCESS

FIELD OF THE INVENTION

The present invention relates to decontamination apparatus and process and more particularly to a process and apparatus for removing radioactive contamination from metal objects, such as tools, valves and the like, in use at nuclear power plants and installations.

BACKGROUND OF THE INVENTION

In the normal day-to-day operation of a nuclear power plant, the tools and other equipment used and operated by the technicians running the plant unavoidably become radioactively contaminated. For the safety and health of the personnel involved, it is therefore necessary to provide a means for safely and easily decontaminating such objects. Such decontamination means should be simple to use so that people can be readily trained in its use, and once trained, will be encouraged to use it frequently thereby minimizing any health hazard posed by radioactively contaminated objects. Also, such decontamination means desirably would be portable so that it may be readily moved to the site where it can most advantageously be used. Another highly desirable feature of such decontamination means would be that it be entirely self-contained requiring no plumbing hookup, no drains and no special ventilation.

SUMMARY OF THE INVENTION

It is therefore an object of the present invention to provide a decontamination apparatus and process for removing radioactive contamination from metal objects such as tools and other equipment normally used in a nuclear power plant, and particularly for removing all low level contamination including loose (adhered) and fixed (imbedded) contamination from all kinds of objects made from metals and metal alloys in use at nuclear installations.

It is another object of the invention to provide such a decontamination apparatus and process which are easy to use and require relatively little training of operating personnel.

It is also an object of the invention to provide a decontamination apparatus in which the operator and the surrounding environment thereof has maximum radiation protection "ALARA" (as low as reasonably achievable).

It is a further object of the invention to provide such a decontamination apparatus which is entirely self-contained and portable.

The foregoing and other objects are attained by providing an apparatus which consists of three separate pieces. The first is an electro-polishing tank, pump and filter assembly, ventilation duct and filter assembly, and a DC power supply. The second is a rinse tank and a pump and filter assembly for the rinse tank. The third is a divot crane. The electro-polishing tank assembly and the rinse tank assembly are each separately mounted on pallets to facilitate moving by a fork-lift truck. The filter systems of the electro-polishing tank and the rinse tank are designed to remove the radioactive contamination from the fluids of those tanks. Heavy items or highly contaminated items are handled with the divot crane which is constructed of stainless steel. The elctro-polishing tank and the rinse tank are also made of stainless steel. The ventilation system on the elctro-polishing tank is designed to exhaust acid fumes resulting from the tank heaters and the electro-polishing process through a filtering system in the ventilation system. Inside the electro-polishing tank are two swinging arms that carry two stainless steel probes that hang down in the electrolyte fluid. These are negative DC probes and are electrically isolated from the tank and the rest of the system. Across the top center of the tank is a copper pipe, which is also electrically isolated from the tank. This is the positive side of the DC system.

To decontaminate a metal object, it is suspending from the positive copper pipe, with good electrical contact, into the electrolyte fluid. The negative probes are then moved on their swinging arms to a close proximity to the object being decontaminated, without making contact. The combination of the electrical field in conjunction with the electrolyte fluid removes a microthin layer of metal including the "fixed" contamination. This "stripped" metal collects as a "mock plating" on the negative probes along with the radioactive contamination that was removed with the metal. Periodically, as contaminated material is stripped from tools and equipment, waste copper rods are hung off the positive copper pipe and the leads from the DC power supply are reversed. This causes the waste copper rods to become negative and the stainless steel probes to become positive. In a timed cycle, the machine process is reversed and the waste metal from the stainless steel probes now collects on the waste copper rods. The waste copper rods can then be wiped clean, and the wiping material can be disposed of in appropriate radiation waste drums.

BRIEF DESCRIPTION OF THE DRAWINGS

The foregoing and other objects, aspects and advantages of the invention will be better understood from the following detailed description with reference to the accompanying drawings in which:

FIG. 3 is a perspective view of the electro-polishing tank which is part of the apparatus shown in FIG. 1; and FIG. 4 is a perspective view of the rinse tank which is part of the apparatus shown in FIG. 1.

DETAILED DESCRIPTION OF THE INVENTION

Figure 1:
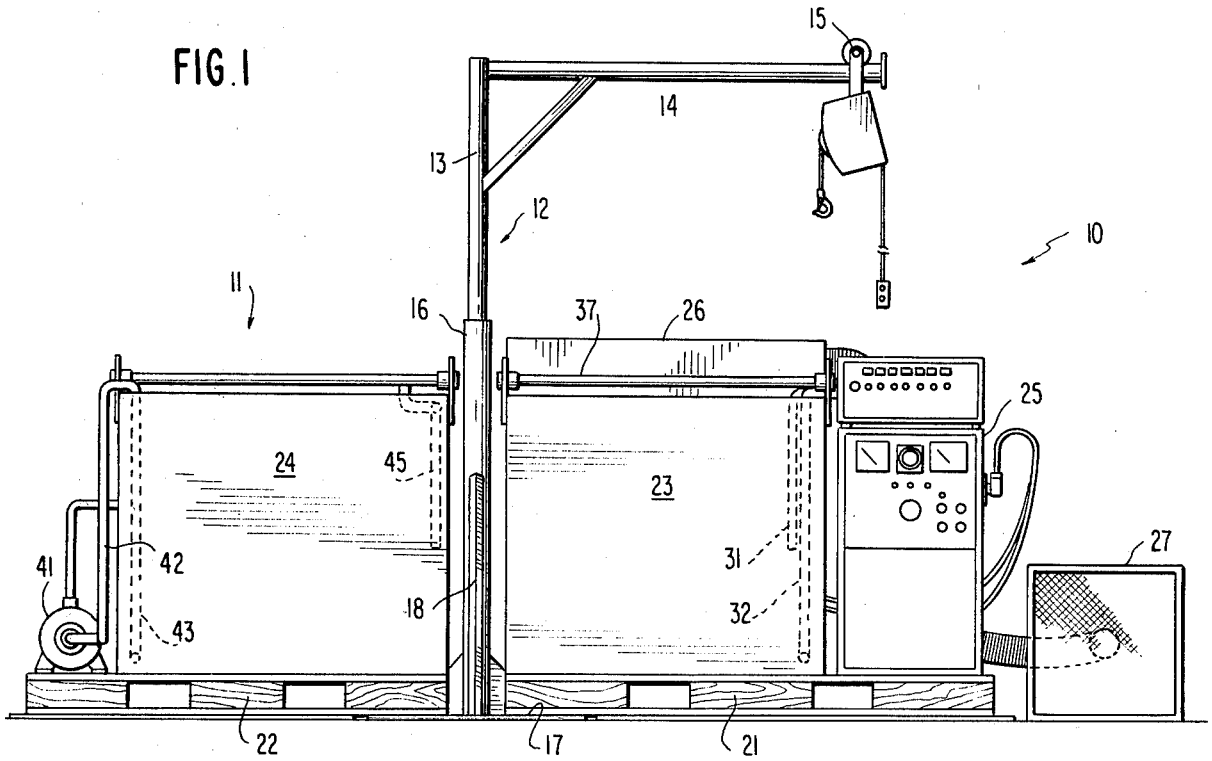
FIG. 1 is a front view of the decontamination apparatus according to the invention.
Figure 2:
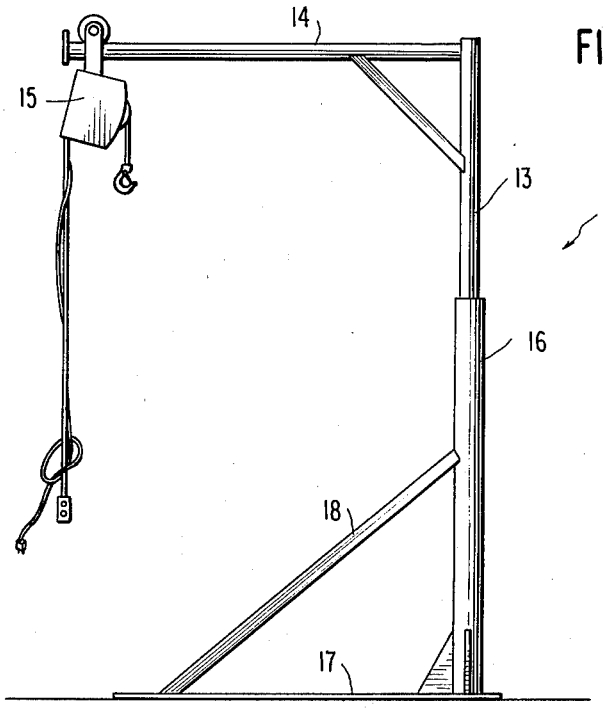
FIG. 2 is a side view of the divot crane which is part of the apparatus shown in FIG. 1.

Referring now to the drawings and more particularly to FIG. 1, the radioactive decontamination apparatus of the invention is shown as it would be arranged in order to carry out its purpose of decontaminating tools and other metal objects. The apparatus comprises an electropolishing tank assembly 10, a rinse tank assembly 11, and a divot crane 12. As shown in FIGS. 1 and 2, the divot crane comprises a vertical support 13 and a horizontal boom 14. At the end of the boom 14, there may be provided an electrical winch assembly 15 which may be movable along at least a portion of the horizontal boom 14. The vertical support 13 fits into and is rotatable in a base support column 16. This base support column 16 is attached to the crane base 17 at one end thereof and supported by a column brace 18 which extends between the column 16 and the base 17.

As best seen in FIG. 1, the electro-polishing tank assembly 10 and the rinse tank assembly 11 are each separately mounted on wooden pallets 21 and 22, respectively. These wooden pallets are placed on the crane base 17 on either side of the column base 18. The weight of the electro-polishing tank assembly 10 and the rinse tank assembly 11 thus stabilizes the divot crane 12.

The electro-polishing tank assembly 10 includes a stainless steel tank 23, an electrical DC power supply 25 and a control panel therefor, and a ventilation system including a stainless steel exhaust duct 26 mounted across the back edge of the tank 23 and a free standing exhaust filter 27. Not shown in FIG. 1 but mounted on the wooden pallet 21 behind the DC power supply 25 is an exhaust blower motor which is connected by flexible duct hose between the exhaust duct 26 and the exhaust filter 27. Also not shown in FIG. 1 is a circulation pump and filter assembly for pumping out, filtering and recirculating the electrolyte fluid in the tank 23.

FIG. 3 shows in more detail the electro-polishing tank assembly. The exhaust blower 29 is shown behind the DC power supply 25 connected by flexible duct hose to the stainless steel exhaust duct 26, which in turn is mounted along the back edge of the tank 23. A stainless steel filter canister 28 is provided for filtering the electrolyte fluid. The electrolyte fluid is pumped into the tank at 23 by means of outlet pipe 31 which extends approximately halfway between the surface of the electrolyte fluid and the bottom of the tank. The electrolyte fluid is pumped out of the tank by means of inlet pipe 32 which extends to the bottom of the tank and includes a pipe which extends across the width of the tank along the bottom of the tank. This pipe has a plurality of holes along its length to pick up the electrolyte fluid.

Mounted within the tank on opposite sides thereof are a pair of swinging arms 33 and 34. These arms are pivotally mounted to the sides of the tank to allow the arms to swing in toward the center of the tank or out away from the center toward their respective sidewall mountings. The swinging arms 33 and 34 are electrically insulated from the stainless steel tank 23. The swinging arms 33 and 34 are provided with fittings at their free ends for carrying a pair of stainless steel metal probes 35 and 36 which extend down into the electrolyte fluid. A copper pipe 37 extends across the top center of the tank and is electrically isolated from the stainless steel tank 23. Flexible insulated electric cables 38 and 39 extend from the DC power supply 25 and make electrical connection to the stainless steel probes 35 and 36, respectively. A separate electrical connection is made between the copper pipe 37 and the DC power supply 25.

In the decontamination process, the stainless steel probes 35 and 36 are connected to the negative side of the DC power supply 25, and the copper pipe 37 is connected to the positive side of the DC power supply 25. To decontaminate a metal object, it must be suspended from the positive pipe 37, with good electrical contact, into the electrolyte fluid. The negative probes 35 and 36 are then moved on their swing arms 33 and 34, respectively, to a close proximity to the object being decontaminated, without making contact.

With the fluid pump and filter system in operation and the ventilation blower on, the operator selects a percentage of available volts and amperes on the DC power supply 25 (0–24 volts and 0–300 amperes), sets the automatic timer (0–6 minutes) and pushes the start button. A combination of the electrical field in conjunction with the electrolyte fluid (typically phosphoric acid and water) removes a micro-thin layer of metal including the "fixed contamination". This "stripped" metal collects as a "mock plating" on the negative probes 35 and 36 along with radioactive contamination that was removed with the metal. After this stripping action, waste copper rods are then hung off the positive pipe 37 and the power leads are reversed at the DC power supply 25, which causes the waste copper rods to become negative. The timer cycle and the DC voltage are then set to a lower volt-amp setting and start button reactivated. The machine process is now reversed, and the waste metal from the negative probes 35 and 36 now collects on the waste copper rods, which may then be wiped clean with paper towels and disposed of in radiation waste drums. The power leads are again reversed, the power selection and timer reset, and the operator is ready for the next object to be decontaminated. The negative probes in the operation described above appear to provide multiple advantages. They enhance the electrical field at the object being decontaminated and also serve to collect the waste metal as well as part of the removed contamination. This prevents the electro-polishing tank itself, from becoming radioactively contaminated.

While the waste stripping is in process, the object that has just been cleaned is moved to and suspended in the rinse tank 24.

With reference to FIGS. 1 and 4, the rinse tank assembly 11 includes a stainless steel tank 24 and a circulation pump 41 mounted on the wooden pallet 22. The circulation pump 41 is connected via pipe 42 to an inlet pipe 43. The inlet pipe 43, like the inlet pipe 32, includes a portion which extends horizontally along the bottom of the tank and is provided with holes in order to pick up the rinse fluid, typically water. The rinse fluid is pumped through a canister filter 44 and then back into the tank via an outlet pipe 45 which extends approximately halfway between the surface of the rinse fluid and the bottom of the tank.

Although not shown in the drawings, both the electro-polishing tank 23 and the rinse tank 24 may be equipped with electric heaters. A particularly preferred arrangement is to use "over the side" tank heaters, which are thermostatically controlled and operated from an electrical control panel, hereinafter described, thereby avoiding the necessity for openings in the tank. Further, these tanks may be provided with tank liners, e.g., of an inert polymeric material such as polyvinyl chloride, fit to the tank shape. These tank liners prevent tank corrosion and also protect the environment from radioactive chemical leaks.

Further, also not shown in the drawings, the rinse tank may be equipped with a high frequency coil which serves two purposes. The first is to provide agitation similar to ultrasonics, and the second is to demagnetize the material that has been processed through the electro-polishing tank but may still have radioactive particles due to magnetism. The high frequency coil would be completely submerged in the rinse fluid along with the object to be demagnetized. The operation of the high frequency coil causes radioactive materials to be released into the rinse fluid which is then processed through the rinse filter 44.

Also, an electrical control panel can be optionally included in the system of the invention for easy control of electrical functions such as tank heaters, exhaust blowers, and the like. Such an optional control panel is shown in FIG. 1 positioned above DC power supply 25.

What is claimed is:

1. Decontamination apparatus including an electro-polishing tank assembly, said assembly comprising:

an electro-polishing tank for holding an electrolyte fluid, a pair of swinging arms attached to said electro-polishing tank but electrically isolated therefrom, a pair of metal probes detachably attached to said pair of swinging arms and extending down into an electrolyte fluid in said electro-polishing tank, a metal support extending across the top of said electro-polishing tank but electrically isolated therefrom, and a DC power supply having positive and negative terminals, said positive terminal being connected to said metal support and said negative terminal being connected to said pair of metal probes, whereby an object to be decontaminated is suspended, with good electrical contact, from said metal support into an electrolyte fluid in said electro-polishing tank and said pair of metal probes are then moved on said swinging arms to a close proximity to said object, without making contact.

2. Decontamination apparatus as recited in claim 1 further comprising as part of said electro-polishing assembly a pump and filter connected to pump out, filter and recirculate an electrolyte fluid in said electro-polishing tank.

3. Decontamination apparatus as recited in claims 1 or 2 further comprising as part of said electro-polishing assembly a ventilation system positioned to exhaust fumes resulting from the electro-polishing process.

4. Decontamination apparatus as recited in claim 1 wherein said pair of metal probes are made of stainless steel and said metal support is made of copper.

5. Decontamination apparatus as recited in claims 1 or 4 wherein said electro-polishing tank is made of stainless steel.

6. Decontamination apparatus as recited in claim 1 wherein said electro-polishing tank assembly is mounted on a pallet to facilitate movement of said assembly by a fork lift truck.

7. Decontamination apparatus as recited in claim 1, said apparatus further including a rinse tank assembly, said assembly comprising:

a rinse tank for holding a rinse fluid, and a pump and filter connected to pump out, filter and recirculate the rinse fluid in said rinse tank.

8. Decontamination apparatus as recited in claim 7 wherein said rinse tank is made of stainless steel.

9. Decontamination apparatus as recited in claim 7 wherein said electro-polishing tank assembly and said rinse tank assembly are each separately mounted on pallets to facilitate moving by a fork lift truck.

10. Decontamination apparatus as recited in claim 7, said apparatus further comprising a divot crane for positioning between said electro-polishing tank assembly and said rinse tank assembly to facilitate the lifting of heavy or highly contaminated objects into and out of said electro-polishing tank and said rinse tank.

11. A method of decontaminating metal objects in an electro-polishing tank assembly including a tank for holding electrolyte fluid, a pair of swinging arms attached to said tank but electrically isolated therefrom, a pair of metal probes detachably attached to said pair of swinging arms and extending down into the electrolyte fluid, and a metal support extending across the top of said tank but electrically isolated therefrom, said method comprising the steps of:

hanging an object to be decontaminated from said metal support into the electrolyte and making electrical contact between said object and said support, moving said swinging arms so that said metal probes are in close proximity to said object but not making contact therewith, and applying a positive and a negative voltage respectively to said metal support and to said metal probes for a predetermined time period to strip a microthin layer of metal, including any contamination, from said object and plate the same on said metal probes as a mock plating, and thereafter removing said object.

12. The method of claim 11, further comprising the steps of:

periodically hanging a waste metal rod from said metal support into the electrolyte and making the electrical contact between said waste metal rod and said support, moving said swinging arms so that said metal probes are in close proximity to said waste metal rod but not making contact therewith, and applying a negative and a positive voltage respectively to said metal support and to said metal probes for a predetermined time period to strip said mock plating from said metal probes and plate the same on said waste metal rod, and thereafter removing said waste metal rod.

* * * * *